United States Patent [19]

Bullivant

[11] Patent Number: 5,060,877

[45] Date of Patent: Oct. 29, 1991

[54] AUTOMATIC PAPER FEED APPARATUS

[75] Inventor: Robert F. Bullivant, Interlaken, N.Y.

[73] Assignee: NCR Corporation, Dayton, Ohio

[21] Appl. No.: 507,559

[22] Filed: Apr. 11, 1990

[51] Int. Cl.[5] ..... B65H 16/08; B65H 16/10

[52] U.S. Cl. ..... 242/55; 242/68.7; 242/76

[58] Field of Search ..... 242/55, 55.53, 68.7, 242/78.7, 76; 226/196

[56] References Cited

U.S. PATENT DOCUMENTS

| | | | |
|---|---|---|---|
| 2,220,230 | 11/1940 | Gilbert | 242/80 |
| 2,683,570 | 7/1954 | Ferm | 242/78.8 |
| 3,039,710 | 6/1962 | Walter | 242/76 X |
| 3,489,361 | 1/1970 | Marion et al. | 242/55 |
| 3,622,095 | 11/1971 | Turner | 242/55 |
| 3,861,610 | 1/1975 | Landis et al. | 242/55 |
| 3,972,487 | 8/1976 | Costa | 242/68.7 |
| 4,066,220 | 1/1978 | Beck et al. | 242/55 |
| 4,141,516 | 2/1979 | Olson | 242/55.53 |
| 4,239,404 | 12/1980 | DeFilipps et al. | 400/613 |
| 4,840,320 | 6/1989 | Shigeta et al. | 242/55 X |
| 4,928,897 | 5/1990 | Satou | 242/55 |

*Primary Examiner*—John M. Jillions

*Attorney, Agent, or Firm*—Wilbert Hawk, Jr.; Stephen F. Jewett; Albert L. Sessler, Jr.

[57] ABSTRACT

An automatic paper feed apparatus includes a receptacle for a paper roll, which receptacle comprises a curved floor and opposite side walls which slope outwardly from bottom to top. The floor is ribbed on it sinner surface to minimize frictional engagement of a leader from the paper roll with said floor. Within the receptacle, the paper roll rests upon a guide roll and a first feed roll which is capable of rotating the paper roll to feed a paper web from the roll. A guide chute is provided which guides movement of the paper web from the paper roll to an exit portion of the guide chute from where it may be introduced into a printer or other device. The guide chute is comprised of a portion of the floor of the receptacle and a movable upper element. The movable upper element is pivotally mounted at one end on the shaft associated with the first feed roll. A second feed roll is positioned between the ends of the guide chute to drive the paper web through the guide chute, and cooperates with pressure rolls mounted on the upper element of the guide chute. A motor is provided for driving the first and second feed rolls.

16 Claims, 7 Drawing Sheets

AUTOMATIC PAPER FEED APPARATUS

BACKGROUND OF THE INVENTION

This invention relates to automatic paper feed apparatus, and more particularly relates to apparatus for automatic insertion of the leader of a paper roll into a feeding mechanism for feeding paper from the roll to a utilizing device.

Paper rolls are widely used to provide record media for receipts and other types of printed records generated by printers employed in business machines such as point-of-sale terminals. The traditional way of loading a printing mechanism paper roll is by inserting a supply core into the paper roll and then placing this assembly between two mounts which act as supports as well as providing guidance for the paper roll as record media is unwound therefrom. Following this, the paper leader is manually inserted into a guide chute arrangement until it contacts a feed roll-pressure roll combination. It is then fed to a printing mechanism by means of a motor and a drive train.

It would be advantageous to eliminate the need for such a manual procedure by providing an apparatus which will cause the leader of the paper roll to be automatically fed to the feed roll-pressure roll combination and on to the printing mechanism.

SUMMARY OF THE INVENTION

The present invention eliminates the need for manual insertion of the leader of a paper roll by utilizing an automatic paper feed and guide chute arrangement to feed and guide the paper to the feed roll-pressure roll combination.

In accordance with one embodiment of the invention, apparatus for automatic feeding of paper from a paper roll comprises a receptacle adapted to receive a roll of paper to be fed, said receptacle being open at the top to permit a paper roll to be placed therein, and having side walls and a curved lower wall to receive the paper roll; a wall member positioned within said receptacle and generally parallel to a portion of said lower wall to form a guide chute having an entry portion and an exit portion to guide movement of paper unwound from said paper roll; guide means rotatably mounted in said receptacle for supporting said paper roll for rotational movement within said receptacle; first feed roll means mounted within said receptacle adjacent said wall member and adjacent the entry portion of said guide chute for engaging and driving said paper roll for rotational movement within said receptacle to cause an end portion of paper from said paper roll to be driven into said guide chute; and second feed roll means mounted to engage paper from said paper roll within the guide chute to drive said paper toward the exit portion of said guide chute.

It is accordingly an object of the present invention to provide an apparatus for automatic feeding of paper from a paper roll.

Another object is to provide an apparatus for feeding of paper from a paper roll in which the need for manual placement or insertion of a leader of a paper roll is eliminated.

With these and other objects, which will become apparent from the following description, in view, the invention includes certain novel features of construction and combinations of parts, a preferred form or embodiment of which is hereinafter described with reference to the drawings which accompany and form a part of this specification.

DESCRIPTION OF THE PREFERRED EMBODIMENT

Figure 1:
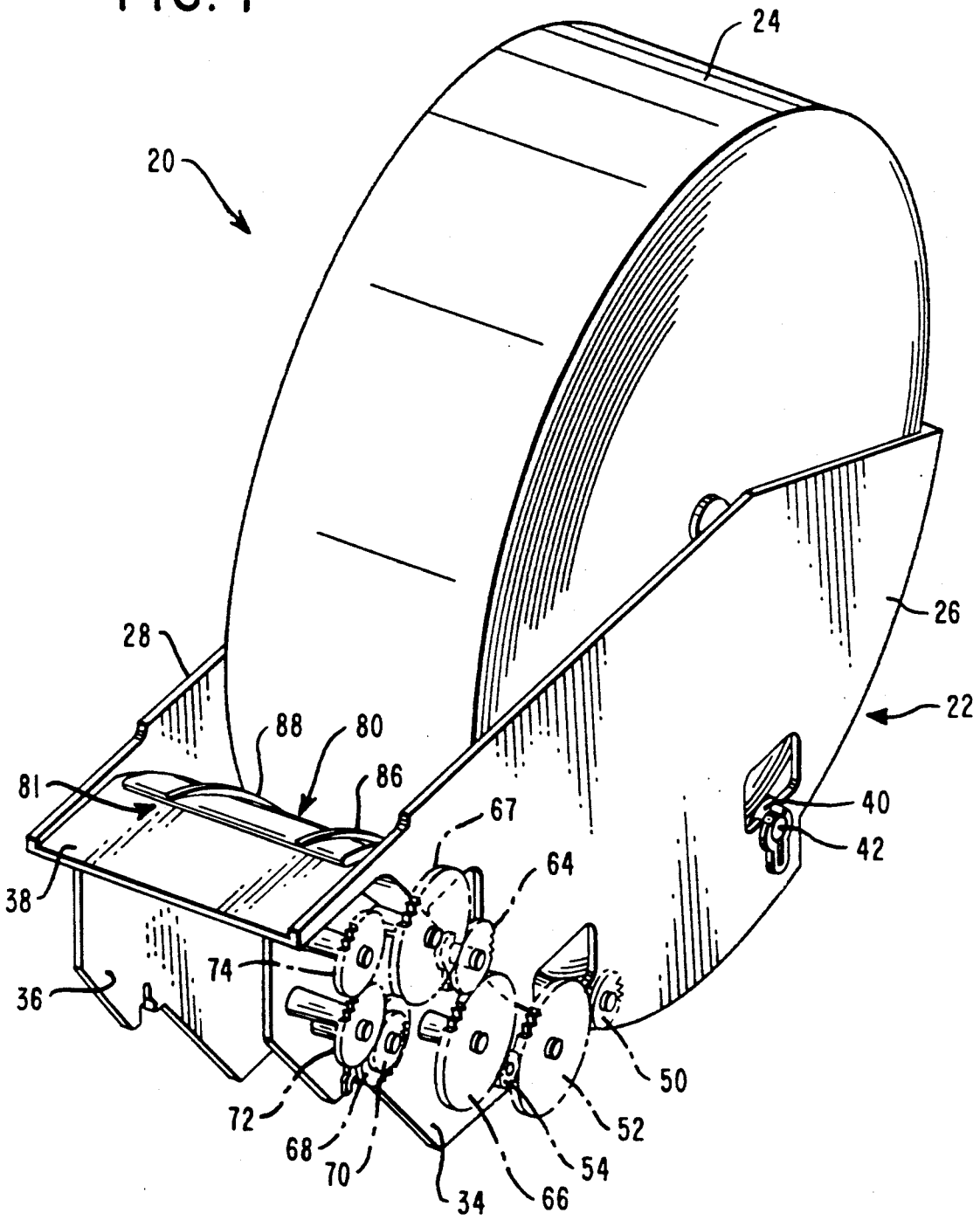
FIG. 1 is a perspective view of the automatic paper feed guide apparatus of the present invention.

Referring now particularly to FIG. 1, the automatic paper feed apparatus 20 shown there in perspective includes a container 22 for receiving a paper roll 24. A paper web 25 from said roll 24 is fed incrementally to a printer (not shown) or other device for causing indicia to be printed thereon. Such a printer may typically be used in a business machine such as a point of sale terminal.

Figure 3:
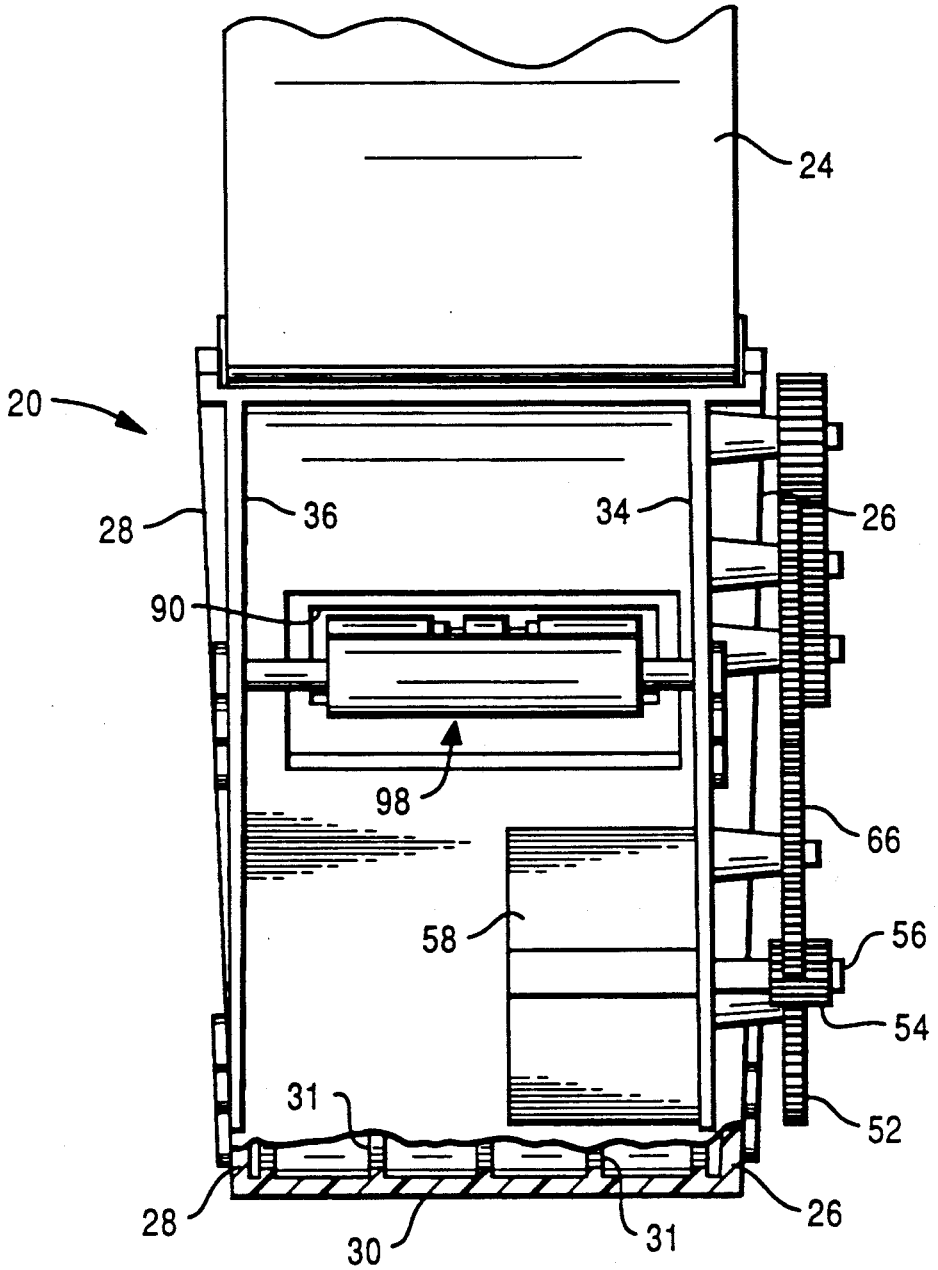
FIG. 3 is an end view of the apparatus of FIG. 1, taken along the line 3—3 of FIG. 2.
Figure 4:
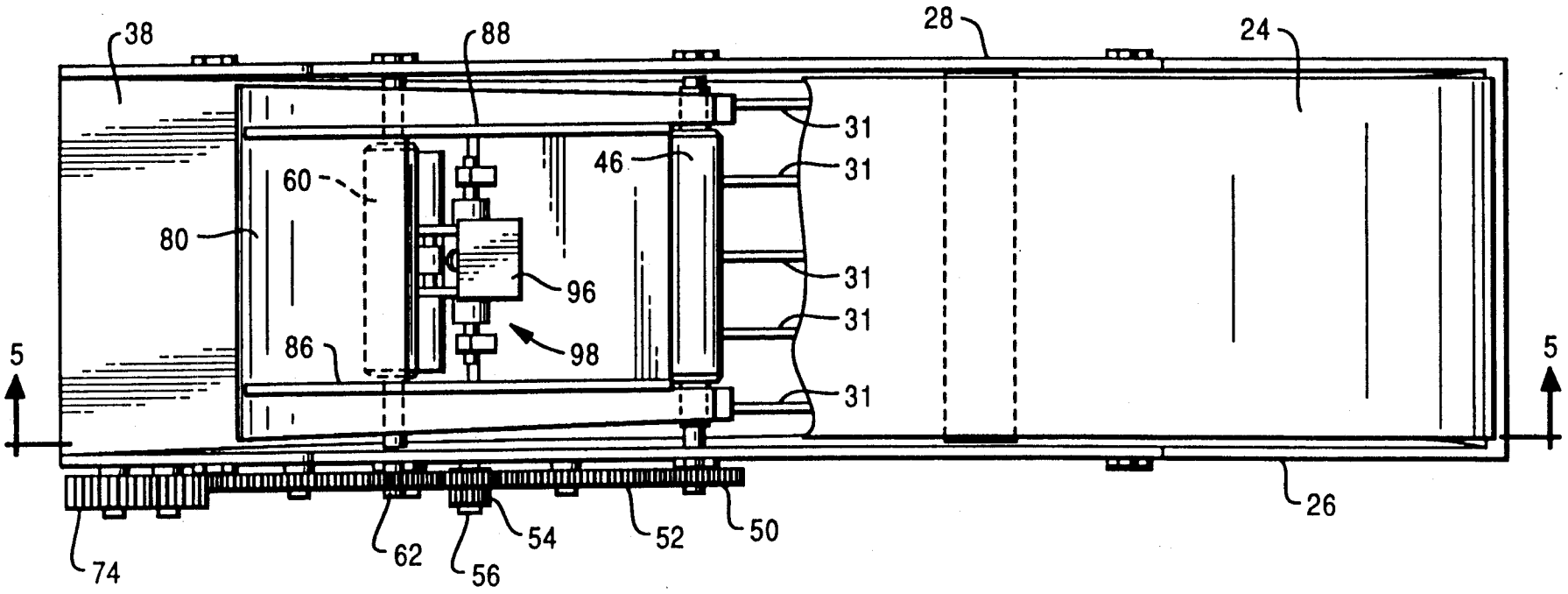
FIG. 4 is a plan view of the apparatus of FIG. 1, taken along the line 4—4 of FIG. 2.
Figure 9:
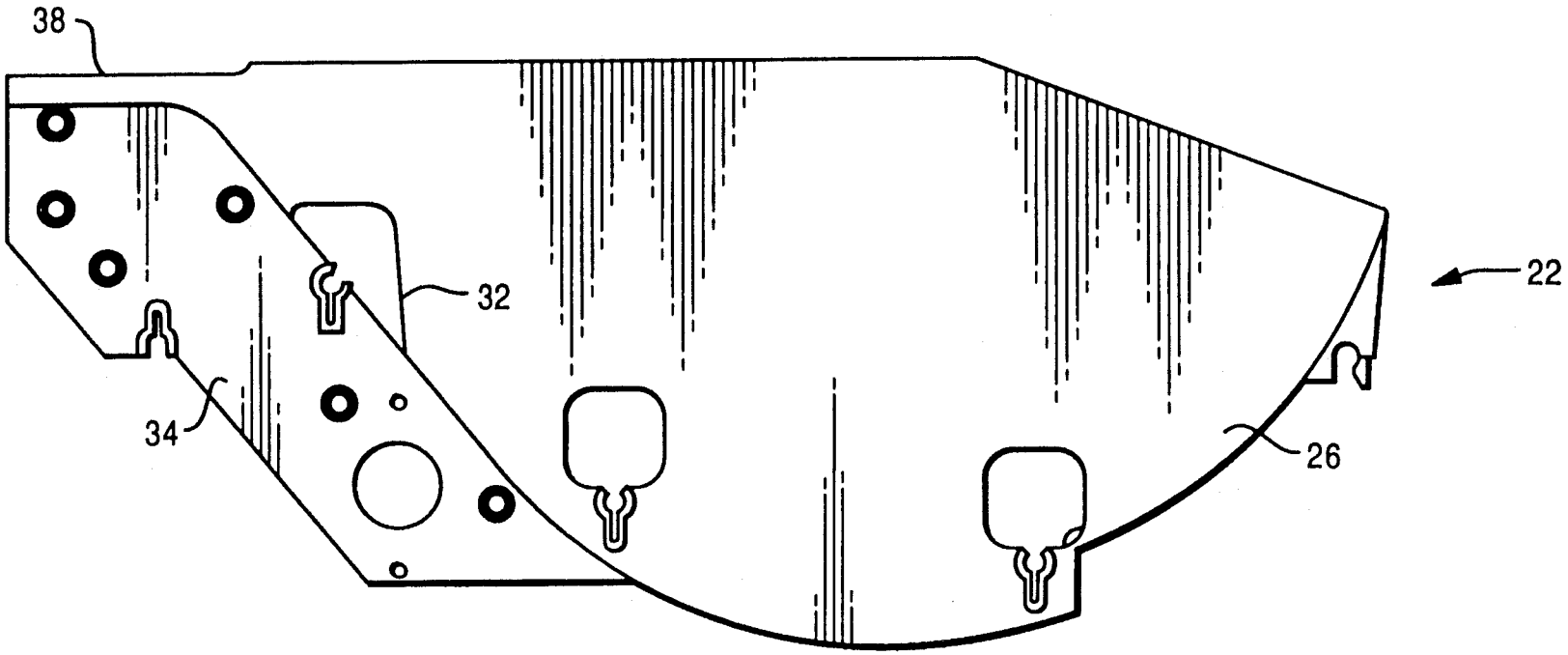
FIG. 9 is a detail view showing a side wall of the container and an associated flange.

As may be seen in the various figures of drawing, the container 22 includes a pair of side walls 26 and 28, and a floor 30 having a first downwardly-extending portion 29. The side walls slope outwardly from bottom to top and extend forwardly to an upwardly-turned portion 32 of the floor 30. As best shown in FIGS. 3 and 9, extending forwardly from the portion 32 of the floor 30 are two parallel flanges 34 and 36 which are positioned inwardly of the side walls 26 and 28. A forward portion of the floor 30 forms a horizontal surface 38 above the flanges 34 and 36 which may be positioned adjacent to the printer. The floor 30 is provided along a portion of its inner surface with a plurality of ribs 31 to facilitate movement of the paper web 25 along said floor by reducing the frictional engagement therewith.

Figure 5:
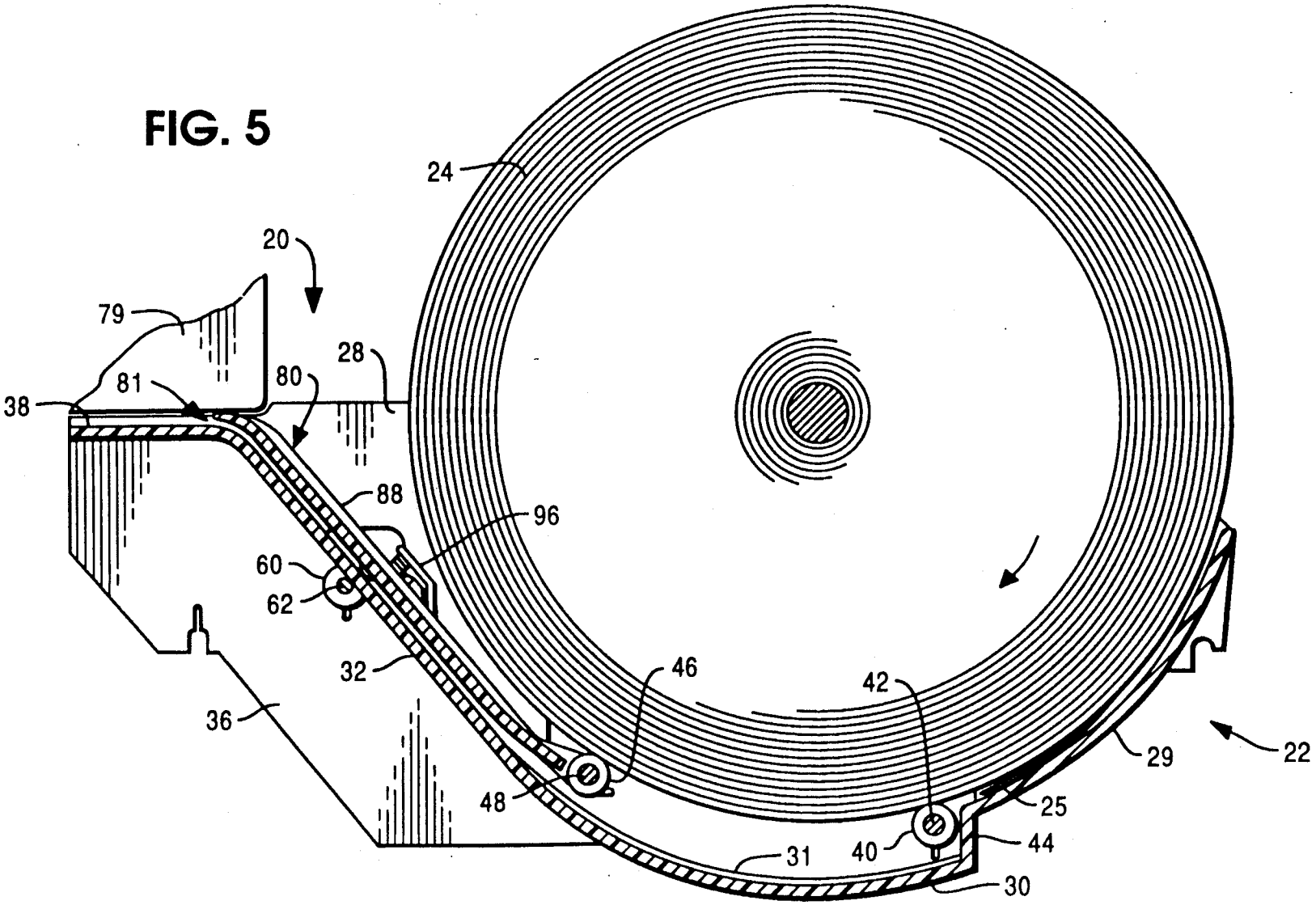
FIG. 5 is a sectional view of the apparatus, taken along line 5—5 of FIG. 4.

The paper roll 24 is partially supported in the container 22 by a guide roll 40 which is mounted for rotation on a shaft 42 journalled in the side walls 26 and 28 and is located in a recessed portion of the floor 30 near a vertical wall portion 44 which is located at the end of the downwardly-extending portion 29. As best seen in FIG. 5, a feed roll 46 also supports the paper roll 24 and causes it to rotate in a clockwise direction, thereby unwinding the paper web 25 therefrom. The feed roll 46 is fixed on a shaft 48 which is journalled in the side walls 26 and 28. Also fixed on the shaft 48 is a gear 50 (FIG. 2) which is coupled via gears 52 and 54 to the shaft 56 of a motor 58 which thereby drives said feed roll 46. The motor 58 is fixed to the flange 34. An additional feed roll 60 (FIG. 5) feeds the web 25. Said roll 60 is fixed on a shaft 62 journalled in the flanges 34 and 36 and extends partially through an opening in the upwardly-turned portion 32 of the floor 30. A gear 64 (FIG. 2) is also fixed to the shaft 62 and is coupled through a mating gear 66 to the gear 54 which is fixed to the shaft 56 of the motor 58. The feed roll 60 is thus also driven by the motor 58.

Figure 2:
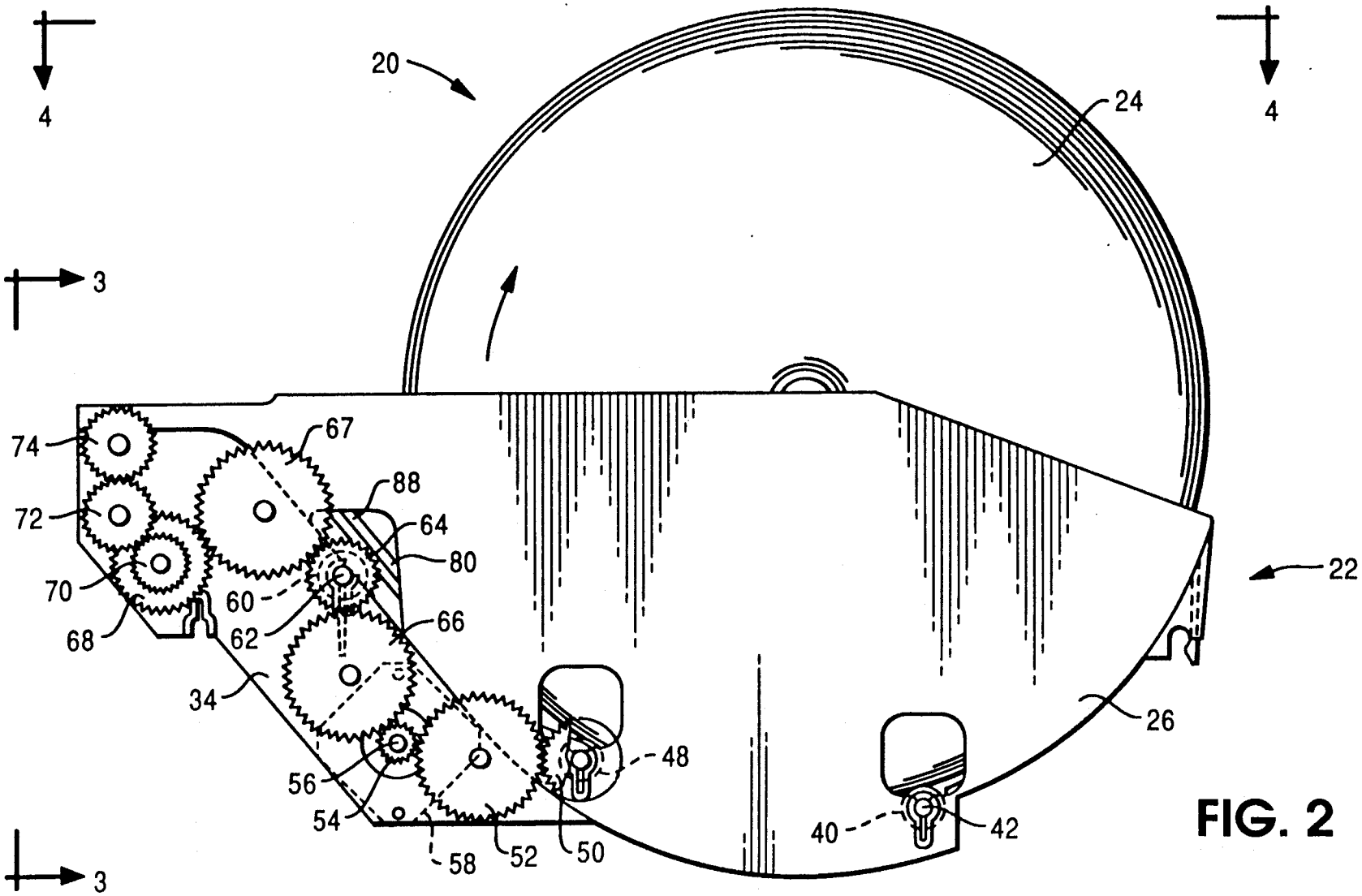
FIG. 2 is an elevation view of the apparatus of FIG. 1.

Also shown in FIG. 2 are gears 66, 67, 68, 70, 72 and 74, all of which are mounted on shafts journalled in the flange 34. These gears are not part of the present invention. They form a gear train, along with gears 56, 66 and 64, which transmits driving movement from the motor 58 to a feed roll mechanism (not shown) in the printer which is associated with the apparatus 20.

Figure 6:
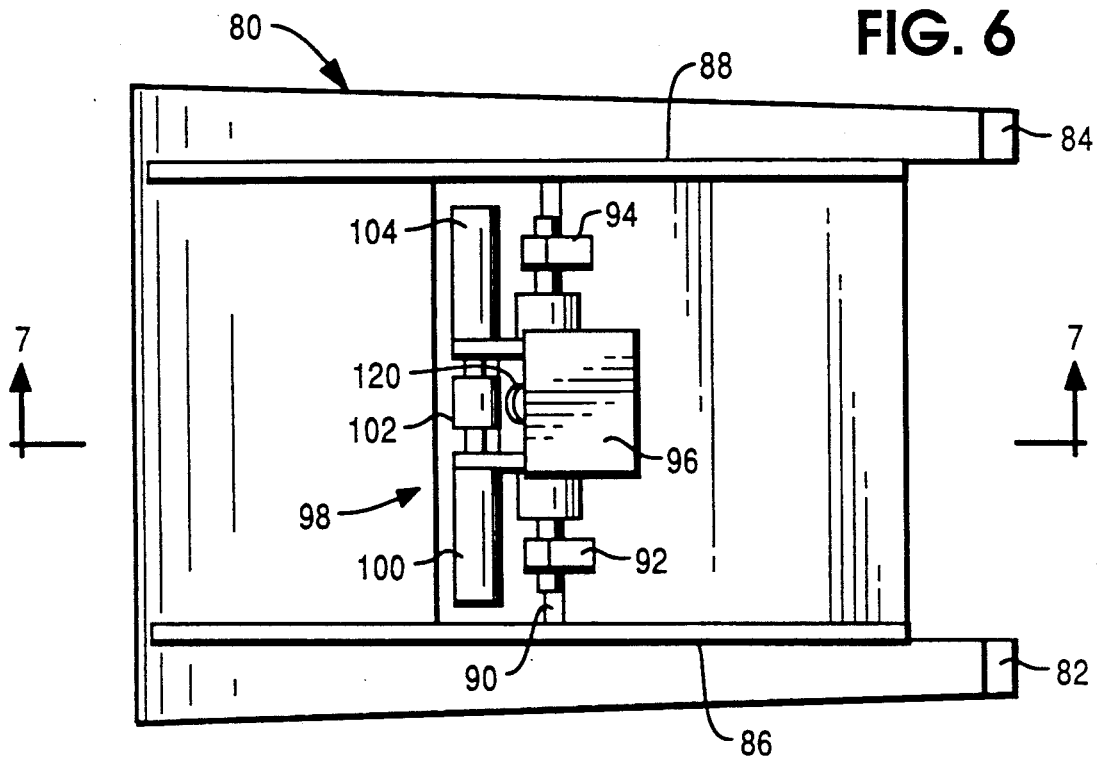
FIG. 6 is a plan view of the upper portion of the guide chute of the apparatus.
Figure 8:
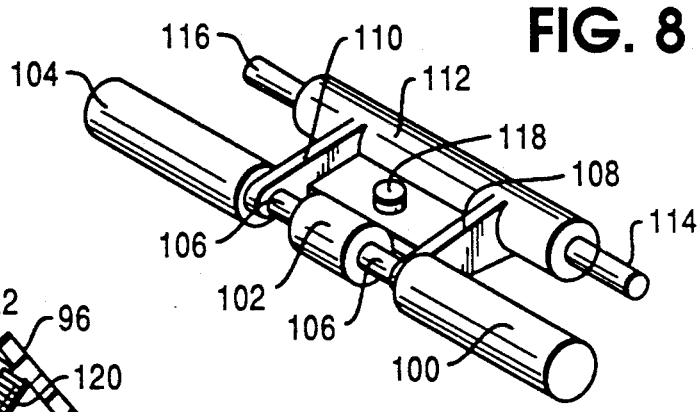
FIG. 8 is a perspective view of the pressure roller assembly of the upper portion of the guide chute.
Figure 7:
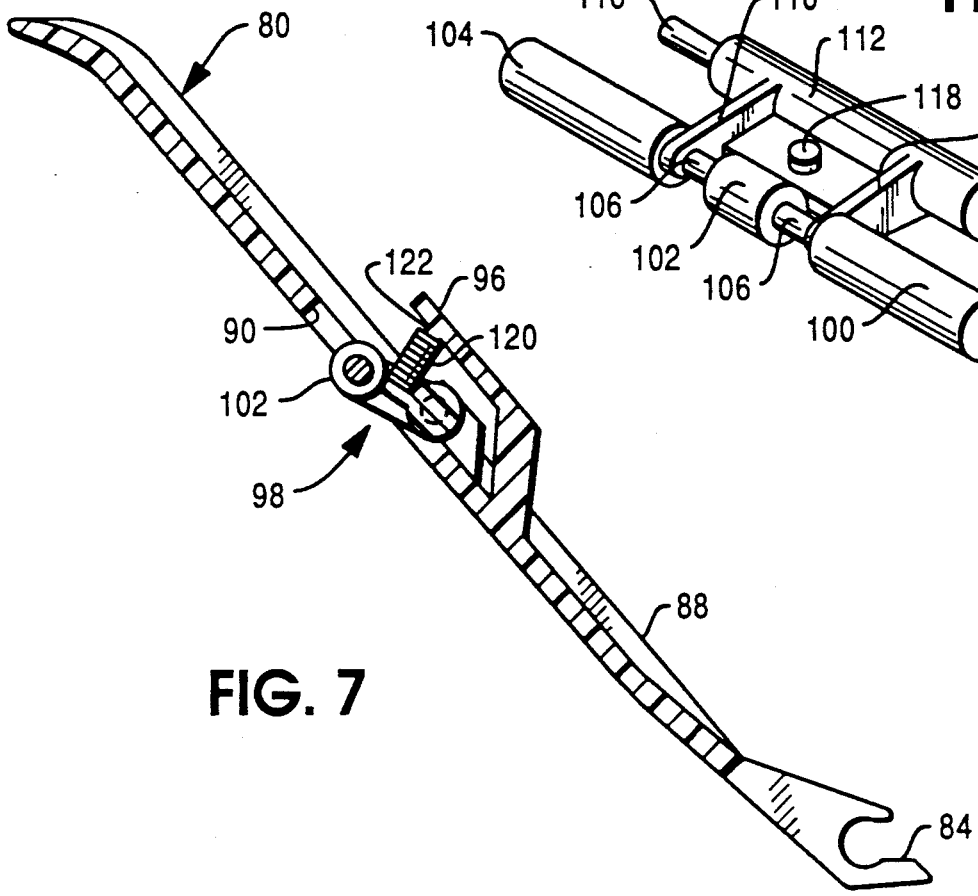
FIG. 7 is a sectional view of the upper guide chute portion of FIG. 6, taken along line 7—7.

Shown in FIGS. 6, 7 and 8 is an upper guide chute element 80 which cooperates with the portion 32 of the floor 30 to form a guide chute 81 for guiding the paper web 25 from the paper roll 24 to the surface 38, from which it can be printed upon by the associated printer. At its lower end, the element 80 includes a pair of C-shaped members 82 and 84 which fit around the shaft 48 of the feed roll 46 and hold the element 80 in position at one end. The element 80 is of generally trapezoidal configuration to enable it to fit within the container 22 which, it will be recalled, increases in width from bottom to top, and is slightly curved at the end adjacent to the members 82, 84 to provide a flared entrance to the guide chute 81 to facilitate entry into said guide chute by the paper web 25. A pair of reinforcing ribs 86 and 88 are provided to maintain the desired rigidity of the element 80. The element 80 is also provided with an opening 90, a pair of shaft retainers 92 and 94, and a support member 96 to accommodate a pressure roll assembly 98, shown in perspective in FIG. 8.

The assembly 98 includes three pressure rolls 100, 102 and 104 on an integral shaft 106. The shaft 106 is rotatably mounted in a pair of bearings 108 and 110 which form part of a pressure roll carrier 112 which also includes a pair of stub shafts 114 and 116 at its ends and a retainer 118 to which a spring 120 is attached at one end. The stub shafts 114 and 116 are pivotally mounted in the shaft retainers 92 and 94. The spring 120 is attached at its other end to a retainer 122 which is integral with the bottom side of the support member 96. The pressure rolls 100, 102 and 104 extend through the opening 90 and cooperate with the drive roll 60 to move the paper web 25 through the guide chute formed by the wall portion 32 and the upper guide chute element 80.

Operation of the automatic paper feed apparatus of the present invention wall now be described. When a new supply of paper for the printer associated with the apparatus is required, a new paper roll 24 is placed in the container 22, so that it rests upon the guide roll 40 and the feed roll 46. The end or leader of the paper web 25 is separated from the remainder of the roll 24 and is placed within the container 22 adjacent to the inside surface of the downwardly-extending portion 29 of the floor 30 of said container, as may best be seen in FIG. 5.

The motor 58 is then caused to be operated by appropriate controls, which causes the feed rolls 46 and 60 to be rotated. Rotation of the feed roll 60 is without immediate effect, since the web 25 has not yet moved into the guide chute 81 formed by the floor portion 32 and the upper guide chute element 80. Rotation of the feed roll 46 causes the paper roll 24 to rotate in a clockwise direction, which in turn causes the web 25 to be further separated from the paper roll 24 and to be extended over the guide roll 40 and into the guide chute 81 formed by the floor portion 32 and the element 80. As the web 25 reaches the feed roll 60, it is further impelled by the feed roll 60 acting in cooperation with the pressure rolls 100 102 and 104 of the pressure roll assembly 98.

It will be seen that the upper guide chute element 80 will be held in position by contact with a cooperating element 79 of the structure into which the paper feed apparatus is placed. The element 79 may be a journal module which is used to supply journal paper to the associated printer. The spring 120 tends to hold the pressure rolls 100, 102 and 104 in engagement with the feed roll 60, but yields to permit the paper web 25 to be moved therebetween, in response to the rotation of the feed roll 46. The paper web 25 is thus driven to the left, as viewed in FIG. 5, through the guide chute and over the surface 38, from where it can be drawn into the associated printer and recorded upon.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

What is claimed is:

1. Apparatus for automatic feeding of paper from a paper roll, comprising:

a receptacle adapted to receive a roll of paper to be fed, said receptacle being open at the top to permit a paper roll to be placed therein, and having side walls and a curved lower wall to receive the paper roll;

a wall member pivotally mounted within said receptacle and movable with respect to said receptacle, said wall member in a normal position being generally parallel to a portion of said lower wall to form a guide chute having an entry portion and an exit portion to guide movement of paper unwound from said paper roll;

a guide roll mounted on a shaft in a recessed lower portion of the receptacle to rotate freely for supporting said paper roll for rotational movement within the receptacle;

first feed roll means mounted on a shaft within said receptacle adjacent said wall member and adjacent the entry portion of said guide chute for engaging and driving said paper roll for rotational movement within said receptacle to cause an end portion of paper from said paper roll to be driven into said entry portion of said guide chute;

second feed roll means mounted to engage paper from said paper roll within the guide chute to drive said paper toward the exit portion of said guide chute; and pressure roll means mounted by mounting means on said wall member and extending through an opening in said wall member in cooperative relation to said second feed roll means for causing movement of paper through said guide chute.

2. The apparatus of claim 1 in which said lower curved wall is ribbed to facilitate movement of paper from said paper roll thereover.

3. The apparatus of claim 2 in which said ribbed lower wall comprises a plurality of ribs disposed in alignment with the direction of paper travel.

4. The apparatus of claim 1, also including drive means for driving said first feed roll means and said second feed roll means.

5. The apparatus of claim 4 in which said drive means comprises a gear train operatively associated with both of said first and second feed roll means and a motor for driving said gear train.

6. The apparatus of claim 1 in which said wall member is flared at the entry portion of the guide chute to provide an enlarged opening to facilitate entry of the end of the paper unwound from the paper roll into the guide chute.

7. The apparatus of claim 1 in which said curved lower wall and said side walls are formed to provide a depending portion of said receptacle to accommodate said guide roll, said first feed roll and said guide chute.

8. The apparatus of claim 1 in which said receptacle has the general configuration of a portion of a cylinder.

9. The apparatus of claim 1 in which said side walls of said receptacle slope outwardly from bottom to top.

10. The apparatus of claim 9, in which said wall member is of generally trapezoidal configuration to match the slope of the side walls of said receptacle.

11. The apparatus of claim 1, in which said wall member includes a pair of C-shaped members at one end thereof to engage the shaft of said first feed roll means to provide a pivot for the pivotal mounting of said wall member.

12. The apparatus of claim 1, in which the mounting means of said pressure roll means on said wall member comprises a plurality of retainers integral with said wall member rotatably supporting shaft means of said pressure roll means.

13. The apparatus of claim 2, also including a support member integral with said wall member, and spring means engaged at one end with said support member and engaged at the other end with the pressure roll means to urge said pressure roll means into engagement with said second feed roll means.

14. The apparatus of claim 13, in which said support member is of generally L-shaped configuration, extends over the opening in said wall member, and is provided with a projection adjacent one end to engage said one end of said spring means.

15. The apparatus of claim 14, in which said pressure roll means includes carrier means having a projection thereon to engage the other end of the spring means.

16. The apparatus of claim 15, in which said pressure roll means includes a plurality of rolls mounted on a shaft journalled in said carrier means, said plurality of rolls being urged toward engagement with said second feed roll means by said spring means.

* * * * *